United States Patent [19]

Zahner

[11] 4,000,789

[45] Jan. 4, 1977

[54] PORTABLE SCAFFOLD

[75] Inventor: Louis J. Zahner, Kansas City, Kans.

[73] Assignee: Edward Engel, Kansas City, Kans. ; a part interest

[22] Filed: Feb. 18, 1976

[21] Appl. No.: 659,097

[52] U.S. Cl. ..... 182/152; 182/63; 182/145

[51] Int. Cl.[2] ..... E04G 1/18; E04G 1/34

[58] Field of Search ..... 182/152, 145, 146, 63, 182/142

[56] References Cited

UNITED STATES PATENTS

| | | | |
|---|---|---|---|
| 2,354,906 | 8/1944 | Bailey | 182/152 |
| 2,420,903 | 5/1947 | Noble | 182/145 |
| 3,130,815 | 4/1964 | Zahner | 182/112 |
| 3,378,101 | 4/1968 | Zeitler | 182/152 |
| 3,463,265 | 8/1969 | Clover | 182/152 |
| 3,576,233 | 4/1971 | Thatcher | 182/145 |
| 3,682,271 | 8/1972 | Boyd | 182/152 |

*Primary Examiner*—Reinaldo P. Machado
*Attorney, Agent, or Firm*—Lowe, Kokjer, Kircher, Wharton & Bowman

[57] ABSTRACT

An improved portable scaffold is the subject of the present invention. A base framework is provided with horizontally telescoping feet to accommodate free movement of the scaffold while still affording maximum stability during use. A telescoping tongue member likewise facilitates transportation but during use of the lifting device may be moved to an out of the way position substantially underlying the plane of the framework. Foldable upright standards are coupled with the framework at each end and mount platform supporting means for movement therealong. A platform member which substantially spans the distance between the upright standards is coupled with the platform supporting means at each end by a hangar bracket which accommodates 90° pivotal movement between the supporting means and the platform. Each bracket also extends away from the supporting means a distance at least equal to the width of one upright standard so as to accommodate folding of the standards one on top of the other.

14 Claims, 10 Drawing Figures

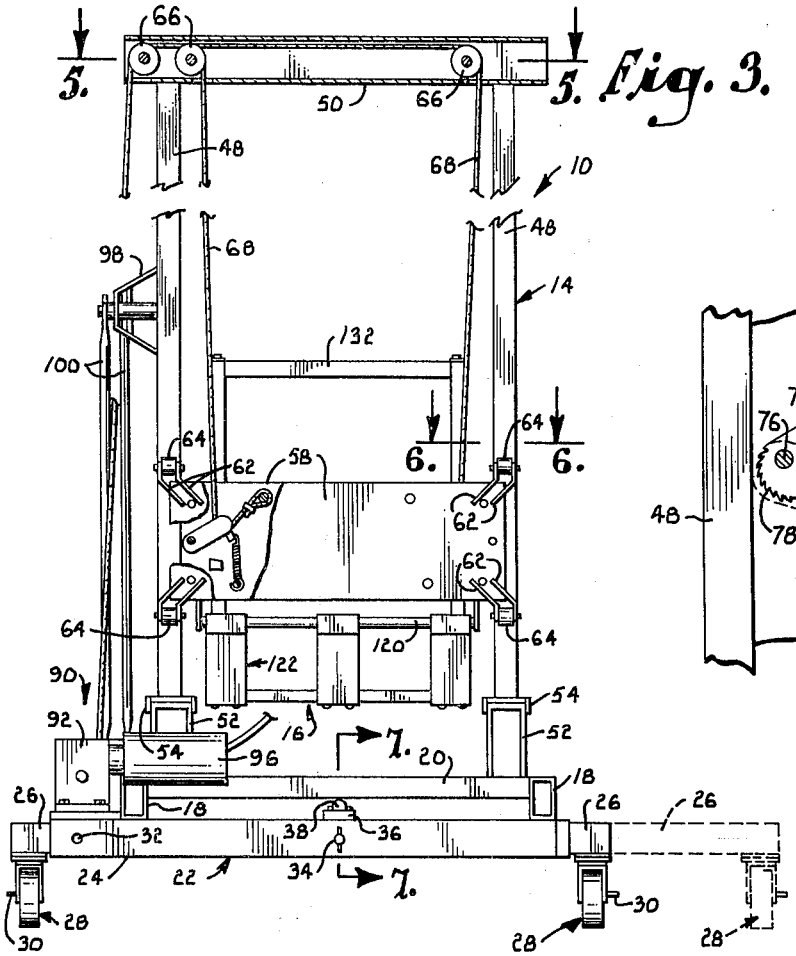
Fig. 3.
Fig. 4.
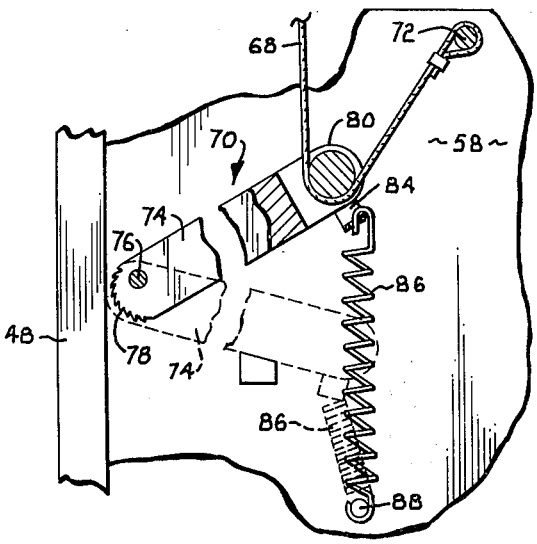
Fig. 5.
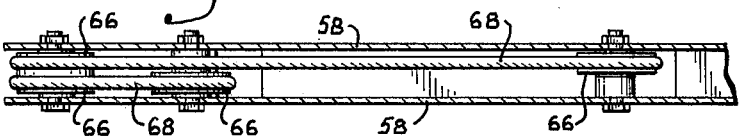
Fig. 6.
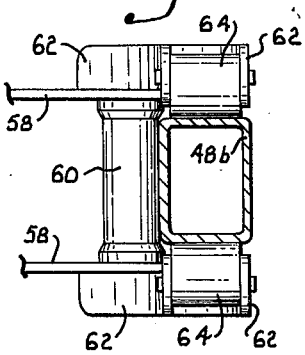
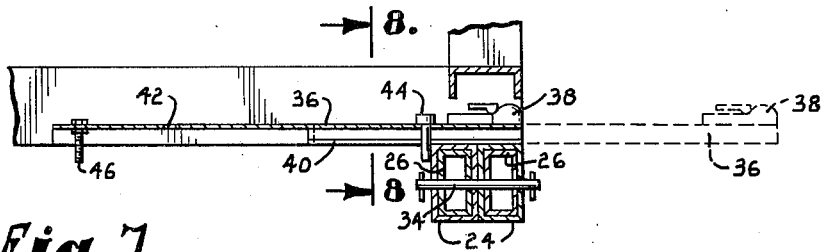
Fig. 7.
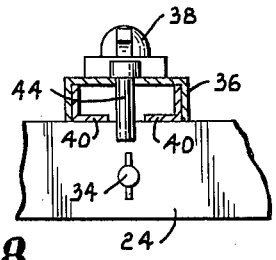
Fig. 8.

PORTABLE SCAFFOLD

This invention relates to lifting devices generally and, more particularly, to a portable scaffold designed for both indoor and outdoor use.

A scaffold of the same general type construction as that which is the subject of the present application is disclosed in U.S. Pat. No. 3,130,815 which issued Apr. 28, 1964 to the present inventor. One of the disadvantages of the construction shown in the reference patent was that it was necessary to remove the scaffold platform before the device could be collapsed. Another disadvantage of this previous construction was found to be the considerable effort required for a single workman to lift the upright supports from a collapsed to an extended position.

The construction of the present invention overcomes the aforementioned disadvantages and offers other significant improvements in the construction shown in the reference patent.

It is therefore a primary object of the present invention to provide a portable scaffold wherein it is not necessary to remove the scaffold platform before collapsing the scaffold for transport purposes.

As a corollary to the above object, it is an important aim of this invention to provide a portable scaffold wherein the scaffold platform may be lowered beneath the horizontal plane of one of the scaffold uprights when the latter is in a folded position so as not to interfere with the folding of the scaffold and not to increase the overall height thereof when folded.

It is another important object of this invention to provide a portable scaffold which utilizes four cables for lifting the platform member and yet only a single winding drum for winding and unwinding of the cables thereby increasing both safety and smoothness of operation without substantially increasing cost of production.

As a corollary to the above object, an objective of the invention is to provide a safety device associated with each cable whereby breakage of any one cable will activate a safety device to stop movement of the scaffold platform.

It is another one of the aims of this invention to provide a portable scaffold wherein the scaffold platform moves along upright standards which comprise telescoping units thereby increasing the overall height to which the scaffold platform can reach without increasing the size of the device when stored in its folded position.

A further object of the invention is to provide a portable scaffold as described in the foregoing objects wherein an angle brace is associated with each upright and the angle brace is spring loaded to assist movement of the uprights from folded to extended positions.

One of the aims of this invention is also to provide a portable scaffold having telescoping feet so as to permit the width of the base to be increased for increased stability during use and then decreased for minimum width when the scaffold is to be transported, particularly when being transported through narrow corridors and doors.

Another one of the objects of this invention is to provide a portable scaffold which employs a telescoping tongue assembly to facilitate towing of the scaffold by another vehicle.

The foregoing and other objects of the invention will be made clear or become apparent from the following description and claims when read in light of the accompanying drawings, wherein:

FIG. 3 is an end elevational view of the lifting device of the present invention, with the device being again shown in the same position as FIG. 1 and with portions broken away for purposes of illustration;

FIG. 4 is an enlarged fragmentary elevational view of the safety device which is associated with each of the lifting cables;

FIG. 5 is an enlarged horizontal cross sectional view taken along line 5—5 of FIG. 3;

FIG. 6 is an enlarged horizontal cross sectional view taken along line 6—6 of FIG. 3;

FIG. 7 is an enlarged vertical cross sectional view taken along line 7—7 of FIG. 3;

FIG. 8 is a vertical cross sectional view taken along line 8—8 of FIG. 7;

Figure 1:
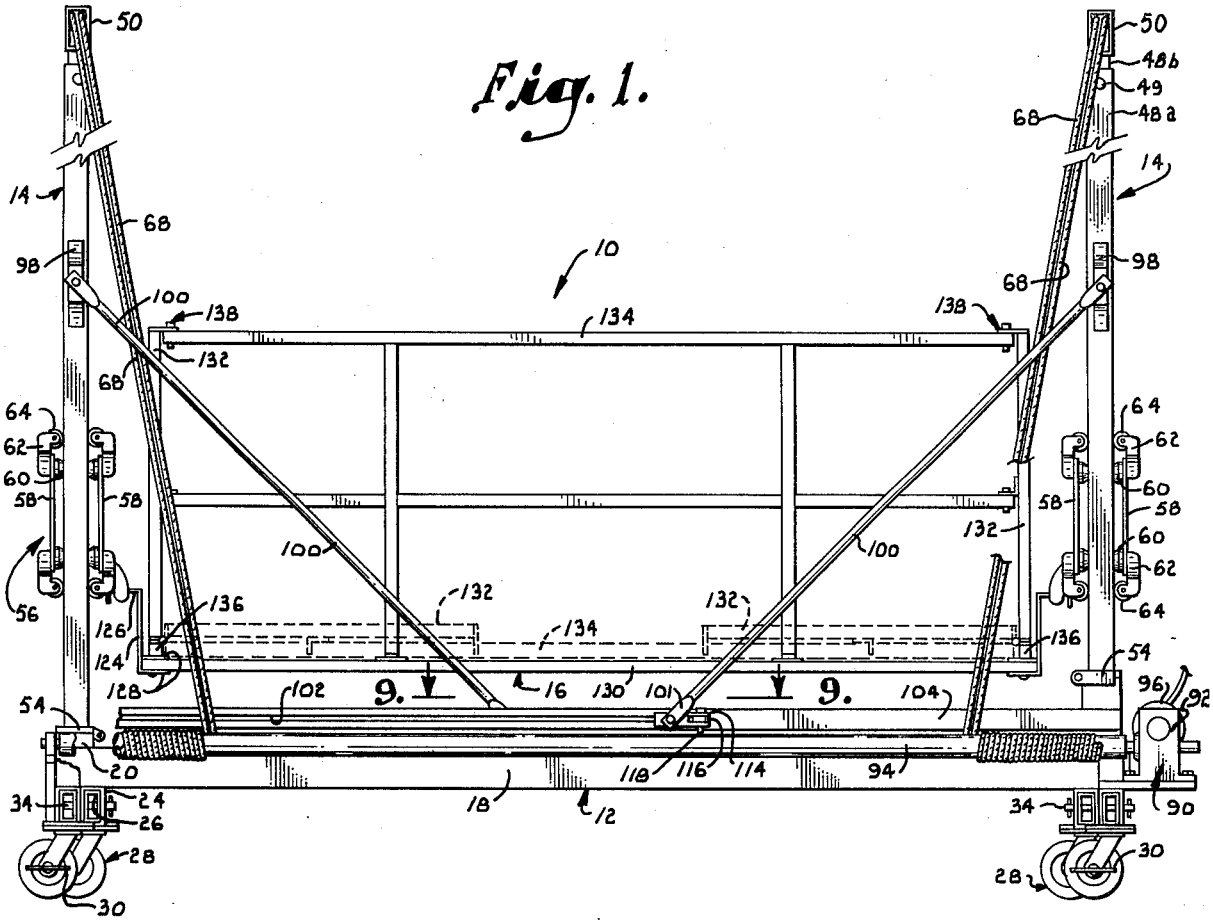
FIG. 1 is a front elevational view of a lifting device according to the present invention as it would be disposed for use.

The lifting device of the present invention will be referred to hereinafter, for convenience, as a portable scaffold and is designated generally by the numeral 10 in each of FIGS. 1–3. Scaffold 10 comprises a base framework designated generally by the numeral 12, first and second elongated upright supports 14, and a platform assembly designated generally by the numeral 16.

Base framework 12 comprises elongated spaced apart channel sections 18 (FIGS. 1 and 3) which are rigidly interconnected at their ends by cross ties 20 (only one of which is visible in FIG. 3). Rigidly coupled with channel sections 18 at each end of the latter are first and second telescoping axle members 22 (FIG. 3). Each axle member 22 comprises a sleeve 24 of generally polygonal cross sectional configuration which slidably receives a complementally configured elongated component 26. Component 26 in turn mounts a castor wheel assembly 28. Each wheel assembly 28 is provided with a force fit locking device of a type well known to those skilled in the art which may be moved from locking to unlocking positions by a foot operated lever 30 (FIG. 1). Sleeve 24 is provided with a plurality of openings 32 which are intended to be aligned with similar openings in component 26 for insertion of a locking pin and a keeper designated by the numeral 34.

Each of the axle members is identical although it is to be noted that the members are mounted in offset relationship to accommodate maximum length for components 26 and thereby provide maximum width for the base framework when the components are in their extended positions. Also, the sleeves 24 on the left side of the scaffold 10, when viewing FIG. 3, project a short distance farther to the side of channel sections 18 than do the sleeves 24 on the opposite side of the scaffold. This permits the extension of sleeves 24 on the left hand side to serve as a mounting point for additional equipment as will be discussed hereinafter.

Referring additionally to FIGS. 7 and 8, it is seen that mounted on sleeves 24 in transverse relationship thereto is a slidable tongue 36. Tongue 36 is constructed from an open channel member and is provided with a ball socket 38 at one end. Two short lengths of angle iron 40 are welded to sleeves 24 to present a guide track for the tongue. A plurality of holes 42 along the length of the tongue releasably receive a locking pin 44, and rigid bolt 46 at the end of the tongue farthest removed from hitch 38 serves as a stop.

The upright supports 14 positioned at each end of base frame 12 will now be described in detail. Since each of the supports 14 is substantially identical only one will be described with like reference numerals being applied to both of the supports. Each support 14 comprises two spaced apart upright standards 48 (FIG. 3) which are held in rigid interconnected relationship by a header beam 50. Each of the standards 48 is also substantially identical and hence only one will be described in detail with like reference numerals being applied to corresponding components of other standards. Each standard 48 is comprised of two telescoping sections 48a and 48b the latter of which mounts beam 50. Each of the standards 48 seen in FIG. 3 is mounted on a block 52 by a hinge plate 54 that is secured both to the standard and to the block. Each of the standards 48 at the opposite end of framework 12 is mounted directly (by a hinge plate 54) on cross tie 20 (in FIG. 1) at a slightly lower elevation than the first mentioned standards.

Mounted on each adjacent pair of standards 48 is a platform support designated generally by the numeral 56 and best illustrated in FIGS. 1 and 3. Each platform support 56 comprises spaced apart plates 58 which are held in rigid relationship by a plurality of rollers 60 (see FIG. 6). Although only two rollers 60 are visible in FIG. 1, (for each support) it is to be understood that two rollers also engage the standard 48 on the opposite side of scaffold 10. Thus, there is a total of four rollers in each support 56 with two rollers on one side engaging one of the standards while the other two rollers engage the other standards. Furthermore, the outside plate 58 is provided with four pairs of ears 62 which mount rollers 64 that also engage standards 48.

Each header beam 50 mounts four pulleys 66 (see FIG. 5) over which are trained cables 68. One of the cables 68 at each end of the scaffold is trained over two pulleys 66 to extend to the far side of the device, when viewing FIG. 1, and then passes through a safety device designated generally by the numeral 70 before being coupled with a mounting pin 72 which is rigid with plates 58 (see FIG. 4).

As illustrated in FIG. 4, the safety device 70 comprises a lever arm 74 which is pivotally mounted on plates 58 by shaft 76. One end of lever 74 presents a cleated foot 78 disposed in close proximity to an adjacent standard 48. The other end of lever 74 presents a yoke 80 having a roller bearing 82 mounted therein around which cable 68 is trained. Extending downwardly from yoke 80 is an ear 84 which mounts one end of a tensioning spring 86. The other end of spring 86 is fastened by a mounting pin 88 rigid with plates 58. Manifestly, so long as cable 68 remains taut the upward force on lever arm 74 is greater than the downward force presented by spring 86 thereby preventing foot 78 from engaging standard 48.

The second cable 68 at each end of scaffold 10 extends over pulleys 66 and downwardly to support 56 at the near side of the scaffold when viewing FIG. 1. This second cable also passes through a safety device 70 as above described before being coupled with plates 58 by mounting pin 72.

Figure 9:
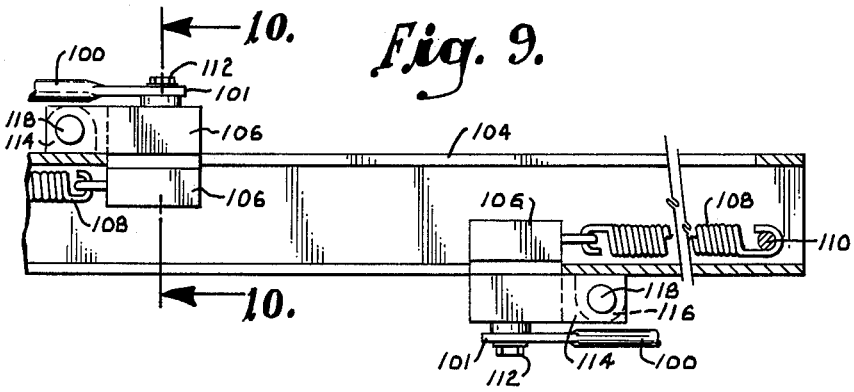
FIG. 9 is an enlarged horizontal cross sectional view taken along line 9—9 of FIG. 1.
Figure 10:
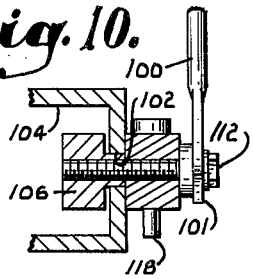
FIG. 10 is a vertical cross sectional view taken along line 10—10 of FIG. 9.

Referring again to FIG. 1 and also to FIGS. 9 and 10, it is seen that cables 68 are raised and lowered by a winch 90 comprising a gear housing 92 in which is mounted appropriate gearing, an elongated winding drum in the form of shaft 94 and electric motor 96 (FIG. 3). As is apparent from viewing FIG. 3, housing 92 is mounted upon the extension of sleeve 24 referred to previously and the end of shaft 94 opposite housing 92 is mounted on the extension of sleeve 24 at that end of the scaffold.

Mounted on the standards 48 on the near side of the scaffold, when viewing FIG. 1, are brackets 98 to which are secured angle braces 100. The other end of each brace 100 is slidably received in a slot 102 of a tube 104. Manifestly, there are two slots 102 in opposites sides of tube 104. A bearing block 106 is received in each slot and the block is in turn coupled with a biasing spring 108. Spring 108 has one end secured to a keeper pin 110 rigid with the tube 104. A bolt 112 passes through an ear 101 at the terminal end of the angle brace 100 to secure the brace to block 106 (see FIG. 10).

As illustrated in FIGS. 1 and 9, a lateral extension 114 of block 106 presents spaced apart leaves with aligned openings for complementally receiving a lobe 116 on the side wall of tube 104 which lobe is also provided with a through aperture therein. The aligned apertures in extension 114 and lobe 116 receive a locking pin 118.

With reference primarily to FIGS. 1 and 3 details of the platform assembly 16 will now be described. First of all, projecting inwardly and downwardly from the inside plate 58 of each platform support 56 is a rigid hangar bar 120. Each hangar bar 120 substantially spans the distance between each pair of upright standards 48.

Pivotally coupled with each hangar bar 120 are a plurality of bracket components designated generally by the numeral 122. Each bracket component 122 comprises an L-shaped member having elongate section 124 and an end 126 which is bent back upon itself so as to present a U forming a pivotal coupling with bar 120. This coupling accommodates pivotal movement of upright standards 48 through an arc of approximately 90° without removing platform member 130. Secured to elongate section 124 at the end opposite end 126 are platform receiving jaws 128. Jaws 128 of each of the brackets 122 receive a platform member 130 which presents a planar surface for carrying workmen or cargo to an elevated location. Mounted on three sides of platform member 130 are railing sections 132 and 134 which cooperate to present a guard rail. Section 134 extends lengthwise of platform member 130 and the two sections 132 (FIG. 3) extend across the width of the platform. All of the sections 132 and 134 are hingedly mounted on the platform 130 with end sections 132 being disposed on mounting blocks 136 so as to place their hinge point above the plane of section 134. An appropriate combination of rigid ears and removable locking pins present a locking assembly 138 to hold sections 132 and 134 in rigid relationship at the points of closest proximity of the sections.

In use, scaffold 10 is normally disposed in the position illustrated in FIG. 1, i.e. its fully extended position. By actuating appropriate controls which may be positioned on the platform or on the ground, motor 96 is energized to either wind or unwind cables 68 on shaft 94. Accordingly, this raises or lowers platform member 130. As explained above, each safety device 70 operates independently and will be activated in the event of breakage of a cable 68. The appropriate height for the scaffold is selected by moving telescoping sections 48*a* and 48*b* relative to each other to raise or lower the height of header beam 50. Two sections 48*a* and 48*b* of each of the standards 48 are locked in place by a bolt 49 which passes through appropriate openings in each of the sections. It will be appreciated that the location of rollers 60 on the inside of standards 48 as well as the location of rollers 64 on two sides of the standards perpendicular to the axis of roller 60 precludes any lateral movement of the platform supports 56 in any direction.

When the scaffold is to be folded for transport or storage purposes, axle components 26 are first moved inwardly within sleeves 24 to reduce the overall width of the scaffold to the minimum possible. Next, the pins of locking assemblies 138 are removed to permit collapse of railing sections 132 and 134. It will be appreciated that section 134 is first pivoted onto platform member 130 and subsequently sections 132 are pivoted onto section 134. This is possible, of course, as a result of the different elevations of the pivot points of the respective sections. The pivot points for sections 132 are located above the pivot points for section 134 by a distance at least equal to the width of section 134. The platform member 130 is then lowered to its lowest position by unwinding cables 68. The locking pin 118 of angle brace 100 at the left-hand side of the scaffold, when viewing FIG. 1, is then removed and the brace 100 and corresponding upright support 14 are pulled against the action of spring 108 to move the upright through a 90° arc into a substantially horizontally position. A sufficient amount of slack in cables 68 is provided to accommodate the swinging movement of upright support 14. It is to be noted than an important aspect of the scaffold construction is that brackets 122 place the lowest most position of the platform member below the plane of the pivot point of the right-hand upright support a distance at least equal to the width of the left-hand upright support (when viewing FIG. 1). This permits the two upright supports to be folded one on top of the other without removing the platform member. Actually, in the instance of the device shown in the drawings, the distance between the platform member 130, when in its lowest possible position, and the plane of the pivot point of right-hand upright support 14 is greater than the minimum distance stated above so as to accommodate folding of railing sections 132 and 134. Manifestly, the distance would not need to be this great, however, if railing sections were omitted as may be desirable in some instances.

Figure 2:
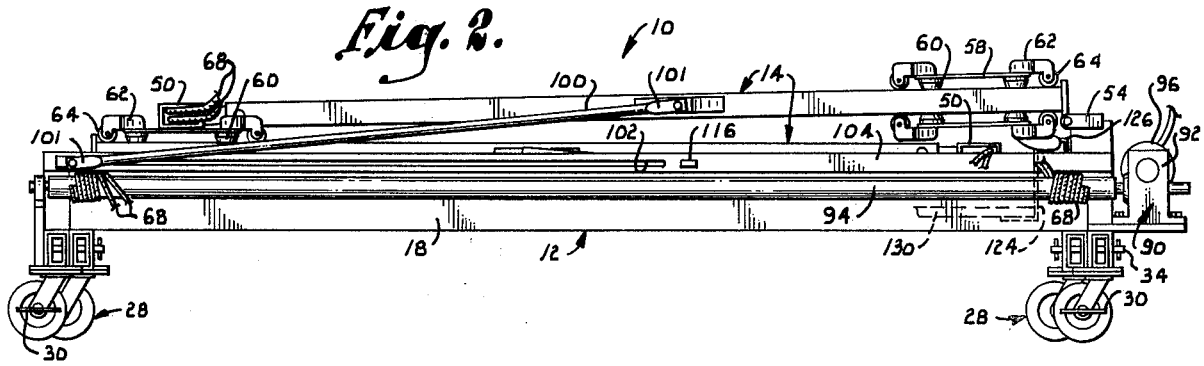
FIG. 2 is a front elevational view, similar to FIG. 1, but with the device shown in a completely folded position ready for transport.

After the left-hand upright support has been folded the locking pin 118 on the second angle brace 100 is removed and the second upright support on the right-hand side of the scaffold, when viewing FIG. 1, is folded through an arc of 90° into the horizontal position shown in FIG. 2.

If the scaffold is to be towed by a vehicle, tongue 36 is extended for this purpose. When the scaffold is again to be used, upright supports 14 are simply moved from their folded to their unfolded extended positions and to this end springs 108 are of substantial assistance. The locking pins are then reinserted, the railing sections 132 and 134 are put in place and operation of the scaffold is possible once axle components 26 have been extended the appropriate distance.

Having thus described the invention, I claim:

1. A lifting device comprising:

a base framework;

first and second elongated upright supports pivotally coupled with said framework in spaced apart relationship, each of said supports being movable from a collapsed position in generally horizontal disposition to an extended position in generally vertical disposition;

first and second platform supporting means for raising and lowering an object, said means being mounted on said first and second upright supports, respectively, for movement longitudinally therealong between raised and lowered positions when said supports are in their extended positions;

a platform member substantially spanning the distance between said supports and adapted to be coupled therewith;

means for mounting one end of said member on each of said platform supporting means, each of said mounting means comprising a bracket presenting a coupling with said supporting means for accommodating pivotal movement of said supporting means relative to said platform mounting means for approximately 90°, an elongate section extending away from said pivotal coupling and means coupled with said elongate section for coupling with said platform member whereby the latter may be lowered to a plane lying below the plane of the pivotal point of one of said supports a distance at least equal to the width of the other of said upright supports; and means coupled with said platform supporting means for moving the platform member up and down along said upright supports.

2. The invention of claim 1, wherein said hangar bracket comprises a generally L-shaped component with the vertical leg thereof presenting said elongate section and the uppermost end thereof being bent back to provide said pivotal coupling.

3. The invention of claim 1, wherein each of said first and second upright supports comprises a pair of standards disposed in spaced apart relationship at one end of said framework.

4. The invention of claim 3, wherein each of said platform supporting means comprises spaced apart plate means having roller means coupled therewith and adapted to ride along said upright supports.

5. The invention of claim 4, wherein is included a header beam extending between each pair of upright standards adjacent the ends of the latter which are farthest removed from said framework, said means for moving the platform supporting means comprising cables coupled with each of said platform supporting means, there being at least one cable pulley mounted on each of said header beams and over which a cable is trained, and winch means for winding and unwinding said cables.

6. The invention of claim 5, wherein is included power means for operating said winch means.

7. The invention of claim 6, wherein is included a cable secured to each of said platform supporting means adjacent each of said upright standards, there being at least three pulleys mounted on each of said heater beams, one of said cables being trained over one pulley and the other cable being trained over two pulleys.

8. The invention of claim 7, wherein said winch means comprises an elongated winding drum extending substantially the length of said framework whereby all of said cables may be wound on said drum.

9. The invention of claim 5, wherein is included a safety lever stop coupled with each of said platform supporting means and operable to engage said upright support to stop movement of said platform supporting means, each of said stops being urged in the direction of an adjacent upright support by yieldable biasing means and held against movement by one of said cables so long as the latter is taut.

10. The invention of claim 3, wherein is included an angle brace extending between one of said upright supports of each pair of supports and said base framework, the latter including an elongated guide track for one end of each of said braces whereby said one end moves along said guide trace as said upright supports are moved between collapsed and extended positions, and means for locking said one end relative to said track when the brace and corresponding upright support are in their extended positions.

11. The invention of claim 10, wherein said guide track comprises a tubular member having opposed slots for coupling said one end of each of said braces therewith, and yieldable biasing means disposed in said tubular member and coupled with said one end of each brace for urging the latter into its extended position.

12. The invention of claim 3, wherein said base framework comprises horizontal telescoping feet for increasing the stability of the framework.

13. The invention of claim 12, wherein two telescoping sections are disposed at each end of the framework, each pair of sections at one end of the framework being offset relative to one another.

14. The invention of claim 3, wherein is included a telescoping tongue member mounted on said base framework, said tongue member being movable in the direction of the longitudinal axis of the framework from a retracted position substantially underlying the plane of the framework to an extended position projecting from said plane.

* * * * *